US012258184B2

(12) United States Patent
Paxson et al.

(10) Patent No.: US 12,258,184 B2
(45) Date of Patent: Mar. 25, 2025

(54) FOOD CONTAINER

(71) Applicant: Doskocil Manufacturing Company, Inc., Arlington, TX (US)

(72) Inventors: Ryan Paxson, Elk Rapids, MI (US); David Veness, Fort Worth, TX (US)

(73) Assignee: Doskocil Manufacturing Company, Inc., Arlington, TX (US)

( * ) Notice: Subject to any disclaimer, the term of this patent is extended or adjusted under 35 U.S.C. 154(b) by 63 days.

(21) Appl. No.: 17/748,598

(22) Filed: May 19, 2022

(65) Prior Publication Data

US 2022/0371790 A1 Nov. 24, 2022

Related U.S. Application Data

(60) Provisional application No. 63/190,936, filed on May 20, 2021.

(51) Int. Cl.
*B65D 45/32* (2006.01)
*B65D 53/02* (2006.01)

(52) U.S. Cl.
CPC ..... *B65D 45/32* (2013.01); *B65D 53/02* (2013.01); *B65D 2543/00101* (2013.01); *B65D 2543/00972* (2013.01)

(58) Field of Classification Search
CPC ..... B65D 45/32; B65D 53/02; B65D 2543/00101; B65D 2543/00972; B65D 39/12; B65D 2543/00083; B65D 2543/00296; B65D 2543/00509; B65D 2543/00953; B65D 43/022
USPC ..... 220/712
See application file for complete search history.

(56) References Cited

U.S. PATENT DOCUMENTS 835,645 A * 11/1906 Smith ..... B65D 81/266 220/233
2,214,732 A * 9/1940 Kraft ..... B65D 39/12 160/183
5,439,130 A * 8/1995 Waugh ..... F16L 55/11 70/164
5,957,292 A * 9/1999 Mikkelsen ..... H01L 21/67373 414/217
7,455,181 B2 * 11/2008 Matsutori ..... H01L 21/67373 220/323

(Continued)

FOREIGN PATENT DOCUMENTS

GB 2322122 A * 8/1998 ..... B65D 39/12
KR 19980071414 A * 10/1998 ..... B65D 39/12

(Continued)

OTHER PUBLICATIONS

Perfect Seal Container Sample from Container Store, Lifetime Brands, Inc., Garden City, New York, Jan. 2014, 2 pages.

*Primary Examiner* — Don M Anderson
*Assistant Examiner* — Eric C Baldrighi
(74) *Attorney, Agent, or Firm* — Foley & Lardner LLP

(57) ABSTRACT

A food container and its method of construction are disclosed herein. In an embodiment, the food container includes a body and a lid assembly. The body has an interior space. The lid assembly lid assembly includes at least one slide part and a rotating part. The at least one slide part is configured to translate linearly when the rotating part is rotated by a user to cause the interior space to be sealed or unsealed.

18 Claims, 18 Drawing Sheets

(56) References Cited

U.S. PATENT DOCUMENTS

| | | | | |
|---|---|---|---|---|
| 7,971,723 | B1 * | 7/2011 | Chiu | H01L 21/67373 206/711 |
| 8,469,408 | B2 * | 6/2013 | Li | E05C 19/001 292/37 |
| 9,422,089 | B2 | 8/2016 | Wheeler | |
| 10,737,857 | B2 | 8/2020 | Choi | |
| 2008/0295412 | A1 * | 12/2008 | Hsiao | H01L 21/67376 49/475.1 |
| 2015/0101959 | A1 * | 4/2015 | Chou | H01L 21/67373 141/7 |
| 2016/0163575 | A1 * | 6/2016 | Phark | H01L 21/67373 206/710 |
| 2022/0297898 | A1 * | 9/2022 | Hu | B65D 39/12 |

FOREIGN PATENT DOCUMENTS

| | | | | |
|---|---|---|---|---|
| KR | 200472089 | Y1 * | 4/2014 | B65D 45/325 |
| KR | 101401957 | B1 * | 5/2014 | A47J 47/08 |
| KR | 101726702 | B1 | 5/2017 | |
| KR | 1020190098468 | A | 8/2019 | |
| KR | 20190126697 | A * | 11/2019 | B65D 43/02 |
| WO | WO-2019221341 | A1 * | 11/2019 | B65D 43/02 |

* cited by examiner

FOOD CONTAINER

PRIORITY

This application claims priority to U.S. Provisional Application No. 63/190,936, filed May 20, 2021, entitled "Food Container", the entire contents of which is incorporated herein by reference.

BACKGROUND

Field of the Disclosure

The present disclosure relates to a food container. In particular, the present disclosure relates to a food container with a sealable lid assembly.

Background

Various conventional food containers exist for pet treats or other food. However, known food containers have a simple construction and often do not create a reliable airtight or suitable seal for the food located therein.

SUMMARY

The present disclosure provides a durable food container that has an airtight or substantial airtight seal which is easily sealed and unsealed by rotation.

In view of the state of the known technology, one aspect of the present disclosure is to provide a food container including a body and a lid assembly. The body has an interior space. The lid assembly includes at least one slide part and a rotating part. The at least one slide part is configured to translate linearly when the rotating part is rotated to cause the interior space to be sealed or unsealed.

Another aspect of the present disclosure is to provide another food container including a body and a lid assembly. The body includes one or more side wall surrounding an interior space. The lid assembly includes a first slide part, a second slide part and a sealing part. The first slide part and the second slide part are configured to translate in opposite directions to press the sealing part into the one or more side wall to seal the interior space.

Another aspect of the present disclosure is to provide a lid assembly. The lid assembly includes a base part, a rotating part and at least one slide part. The rotating part is configured to rotate with respect to the base part. The at least one slide part is configured to translate linearly with respect to the base part due to the rotation of the rotating part to cause the food container to be sealed and unsealed.

The embodiments described herein provide improved food containers and/or methods for manufacturing and constructing the improved food containers. These food containers are advantageous, for example, because the illustrated construction is durable and easy to seal and unseal. It should be understood that various changes and modifications to the food containers and corresponding components described herein be apparent to those skilled in the art and can be made without diminishing the intended advantages.

Also, other objects, features, aspects and advantages of the disclosed food containers will become apparent to those skilled in the art in the field of food containers from the following detailed description, which, taken in conjunction with the annexed drawings, discloses preferred embodiments of a food container with various features.

BRIEF DESCRIPTION OF THE DRAWINGS

Referring now to the attached drawings which form a part of this original disclosure.

DETAILED DESCRIPTION

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

FIGS. 1-17 illustrate a first example embodiment of a food container 10 in accordance with the present disclosure. In the illustrated embodiment, the food container 10 includes a body 12 and a lid assembly 14. The lid assembly 14 is removeable from the body 12. The lid assembly 14 is configured to provide an airtight seal which can be easily sealed and unsealed by a rotational force provided by a user. In an embodiment, the food container 10 is approximately 8" (length)×6.5" (width)×8.5" (height).

Figure 1:
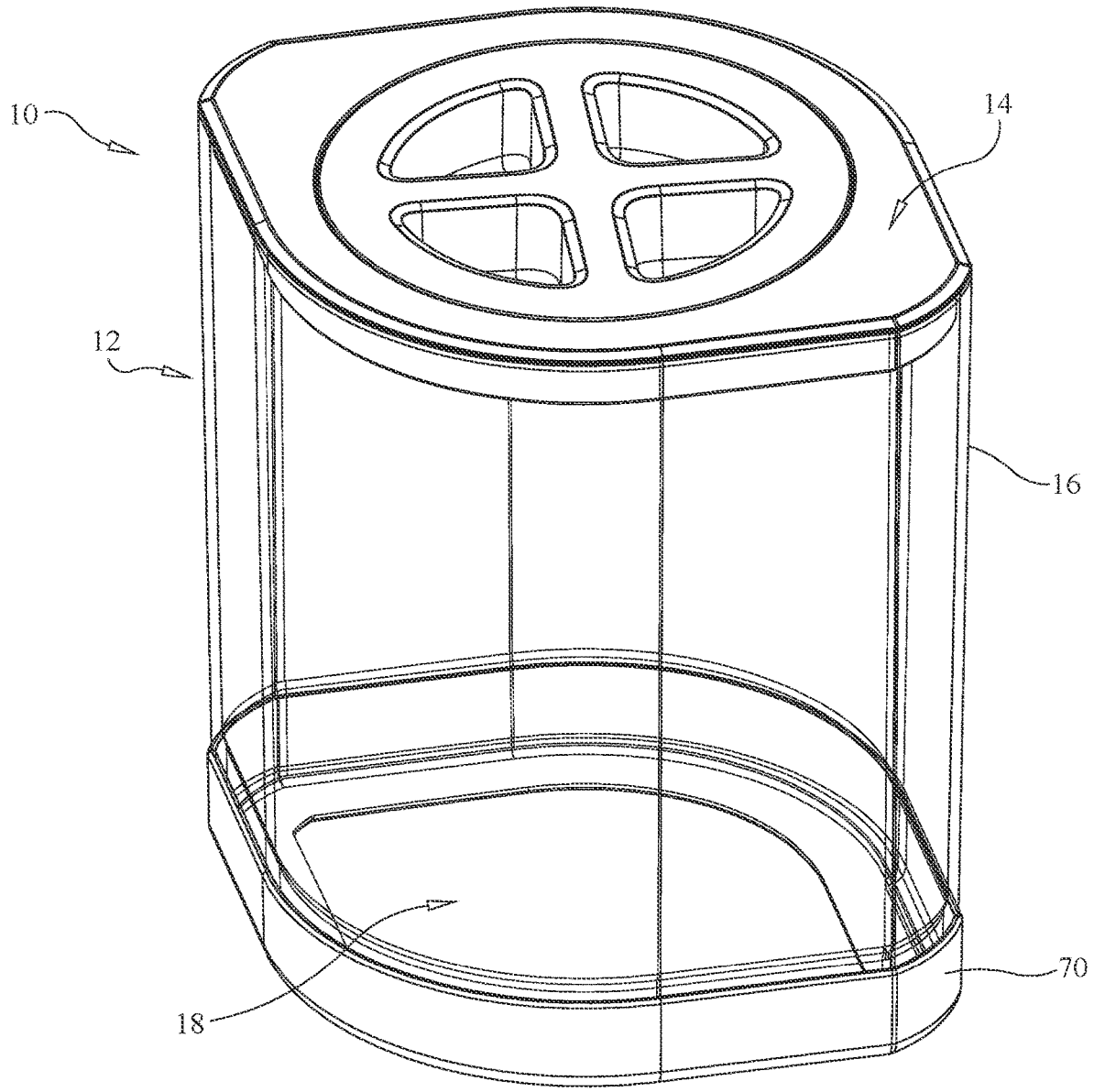
FIG. 1 illustrates a top perspective view of an example embodiment of a food container in accordance with the present disclosure.
Figure 2:
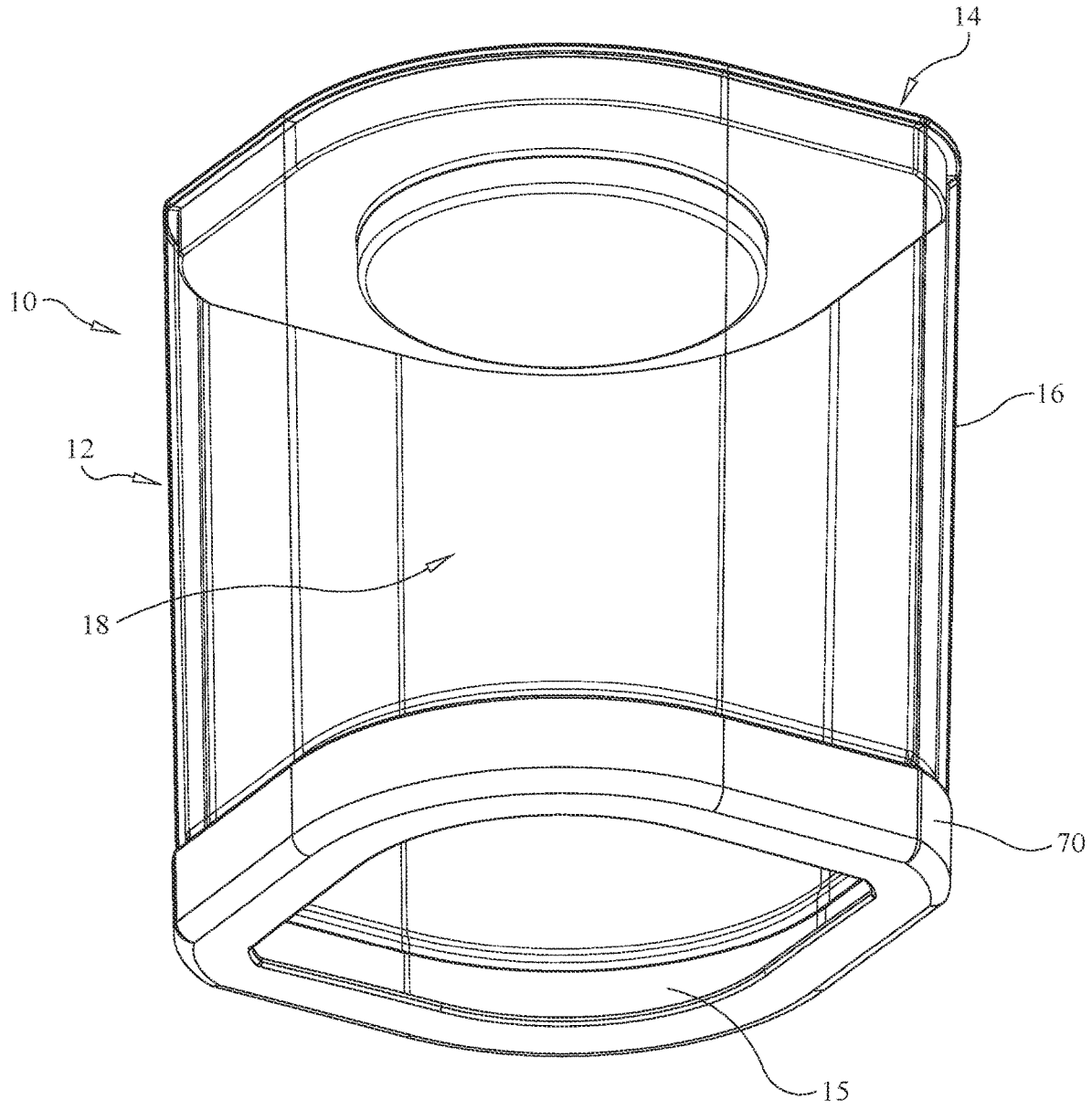
FIG. 2 illustrates a bottom perspective view of the food container of FIG. 1.
Figure 3:
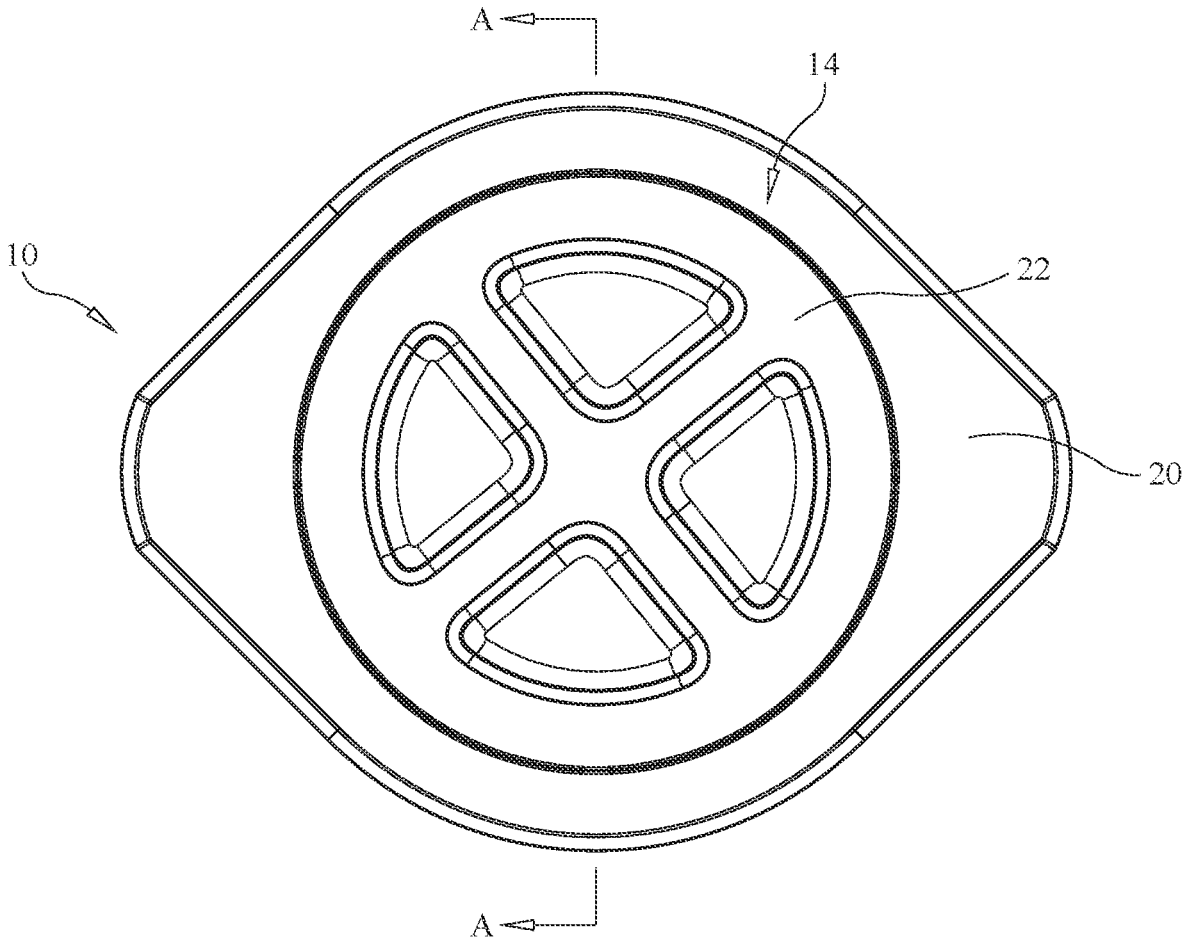
FIG. 3 illustrates a top plan view of the food container of FIG. 1.
Figure 4:
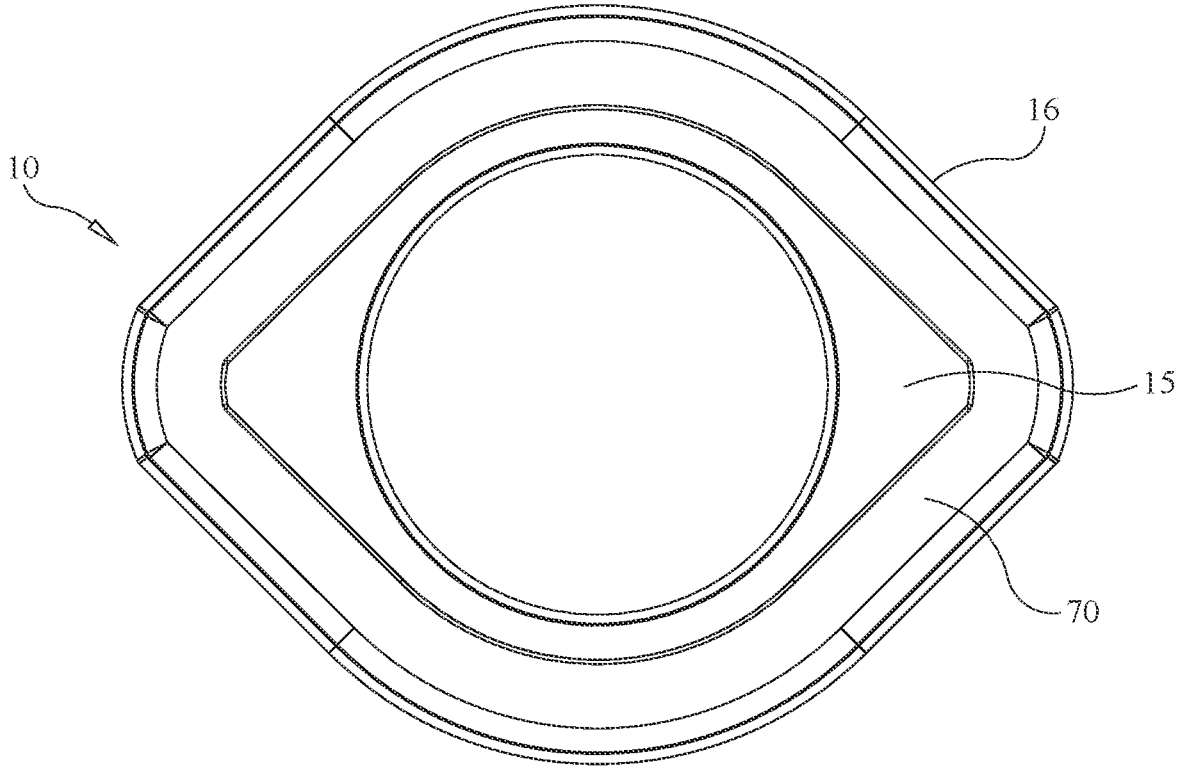
FIG. 4 illustrates a bottom plan view of the food container of FIG. 1.

In the illustrated embodiment, the body 12 includes a bottom wall 15 and at least one side wall 16 which form an interior space 18. The top of the body 12 is open (see FIG. 7) and configured to receive the lid assembly 14. As seen in FIGS. 3 and 4, the side wall(s) 16 form a symmetrical shape on opposite sides from the top and bottom views. Both the body 12 and the lid assembly 14 have a football-like shape from the top and bottom views, with the horizontal length from the top and bottom views being longer than the vertical length. The construction of the lid assembly 14 as described herein enables this shape or other types of irregular shaped containers to be sealed by a rotational force provided by a user.

Figure 5:
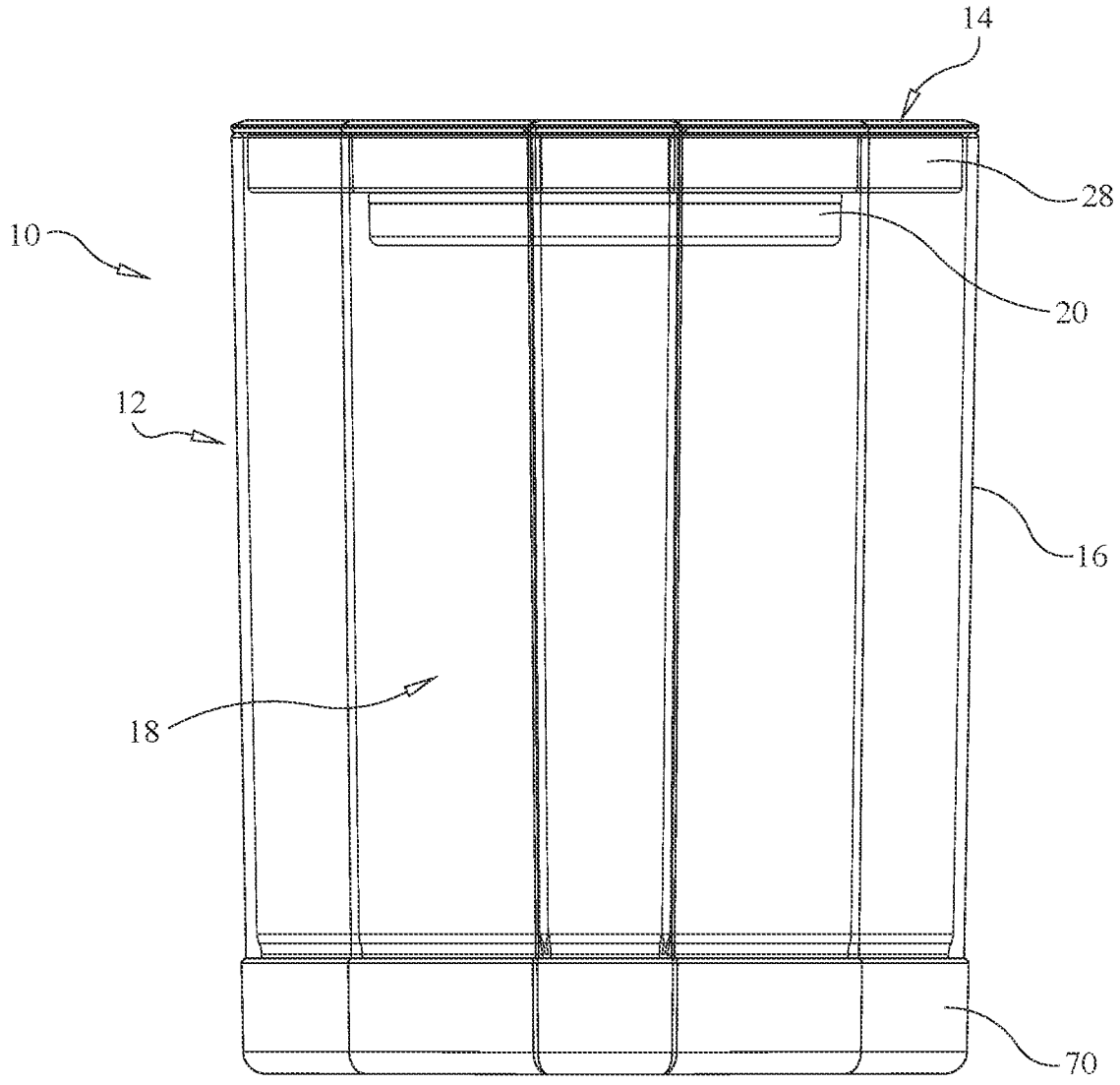
FIG. 5 illustrates a side elevational view of the food container of FIG. 1
Figure 6:
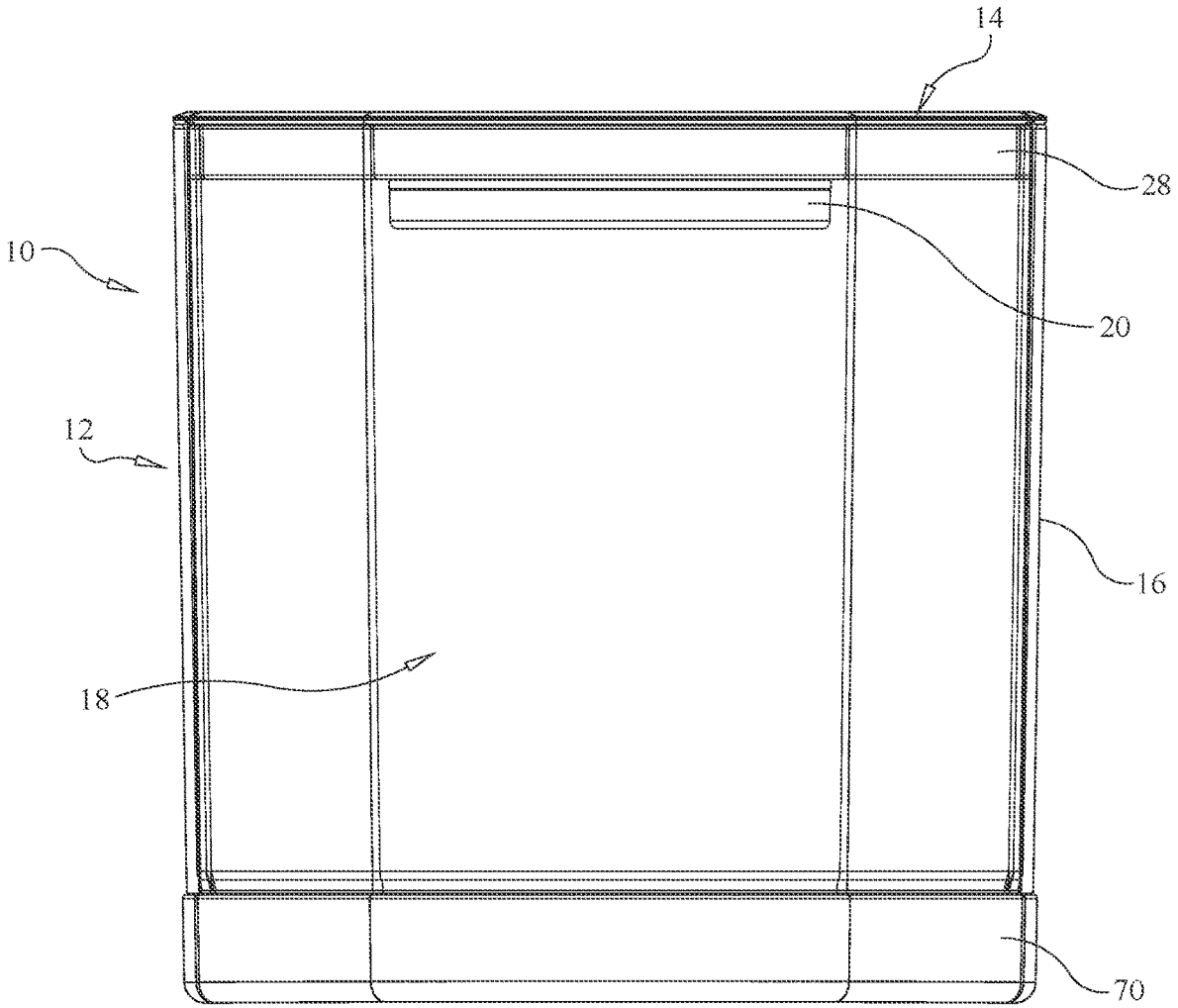
FIG. 6 illustrates another side elevational view of the food container of FIG. 1.

As seen in FIG. 5, the illustrated lid assembly 14 protrudes past the top of the side wall(s) 16 when the lid assembly 14 is attached to the body 12. The body 12 can be at least partially transparent so that the food located within the interior space 18 is visible from the outside. The body 12 can also be tinted to reduce light exposure on food located within the interior space 18. The body 12 can also be opaque. The body 12 can be formed from plastic, for example, from acrylonitrile butadiene styrene (ABS) material. As should be understood by those of ordinary skill in the art from this disclosure, the body 12 can also be formed in another suitable shape or from another suitable material.

In the illustrated embodiment, the lid assembly 14 includes a base part 20, a rotating part 22, a first slide part 24, a second slide part 26, and a sealing part 28. The base part 20 and rotating part 22 have a center axis about which the rotating part 22 rotates with respect to the base part 20. In use, the rotating part 22 rotates around its center axis with respect to the base part 20 to seal or unseal the interior space 18 of the body 12. The rotation of the rotating part 22 causes the first slide part 24 and the second slide part 26 to translate radially in opposite directions away from the center axis. The first slide part 24 and the second slide part 26 translate linearly with respect to the base part 20, the rotating part 22, and the sealing part 28. During translation in the outward radial direction (away from the central axis), the first slide part 24 and the second slide part 26 press the sealing part 28 into the side wall(s) 16 of the body 12, thus sealing the interior space 18 with an airtight seal. During translation in the inward radial direction (toward the central axis), the first slide part 24 and the second slide part 26 release the pressure pressing the sealing part 28 into the side wall(s) 16 of the body 12, thus unsealing the airtight seal provided to interior space 18 by the lid assembly 14.

As seen for example in FIGS. 7-10, the base part 20 includes a top surface 30, a bottom surface 32, and a side surface 33. The base part 20 includes a cavity 34 in the top surface 30. The cavity 34 receives the rotating part 22 such that the rotating part 22 is at least partially rotatable within the cavity 34. The base part 20 can be formed from plastic, for example, from ABS material. As should be understood by those of ordinary skill in the art from this disclosure, the base part 20 can also be formed from any other suitable material.

Figure 10:
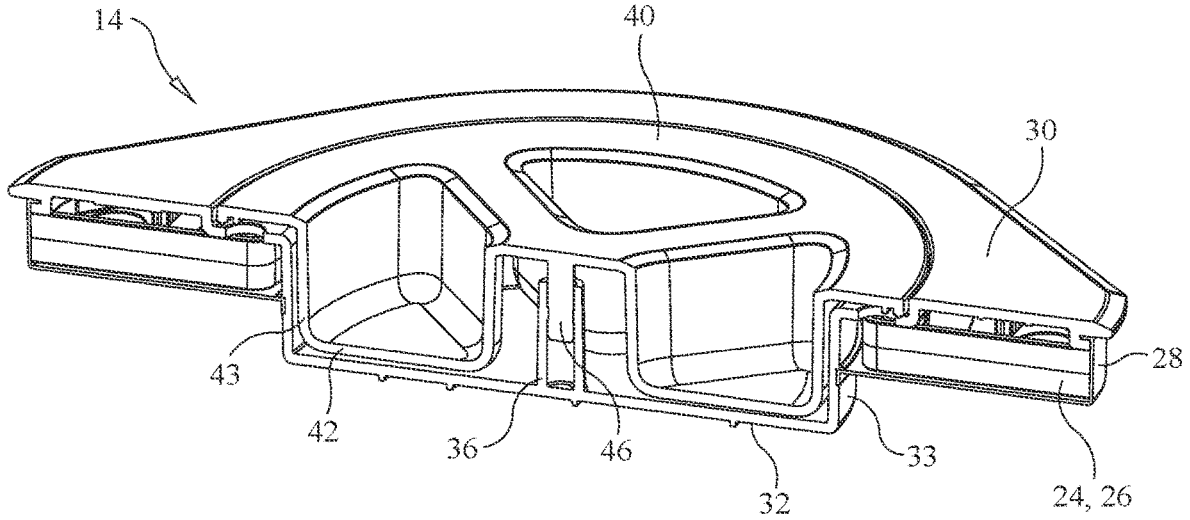
FIG. 10 illustrates a cross-section perspective view of the lid assembly of the food container of FIG. 1 taken across section B-B in FIG. 8.
Figure 11:
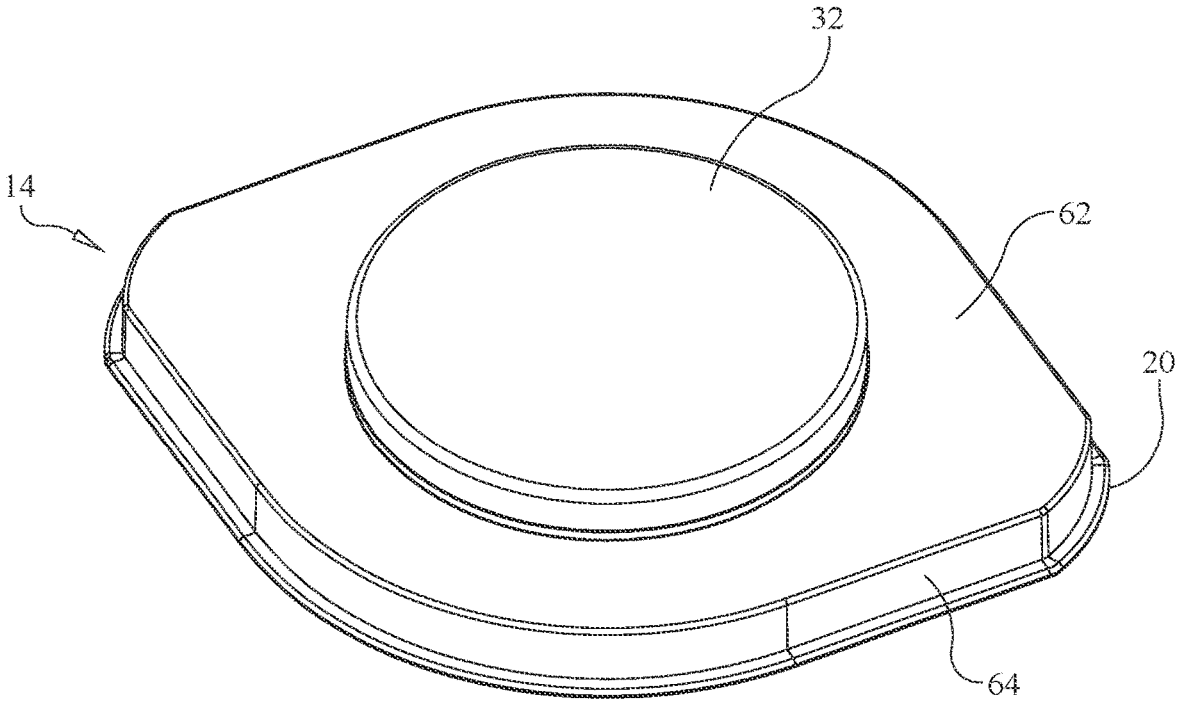
FIG. 11 illustrates a bottom perspective view of the lid assembly of the food container of FIG. 1, with the lid assembly in the unsealed configuration.

In the illustrated embodiment, and as shown in FIG. 10, the base part 20 includes a first protrusion 36. The first protrusion 36 extends upward from the center of the cavity 34 and is aligned with the center axis of the rotating part 22. In the illustrated embodiment, the rotating part 22 attaches to the first protrusion 36 to attach the rotating part 22 to the base part 20 such that the rotating part 22 rotates with respect to the base part 20. The rotating part 22 can attach to the first protrusion 36, for example, via a snap fit, press fit, or another attachment mechanism. Those of ordinary skill in the art will recognize from this disclosure that there are various ways to rotationally attach the rotating part 22 to the base part 20.

Figure 14:
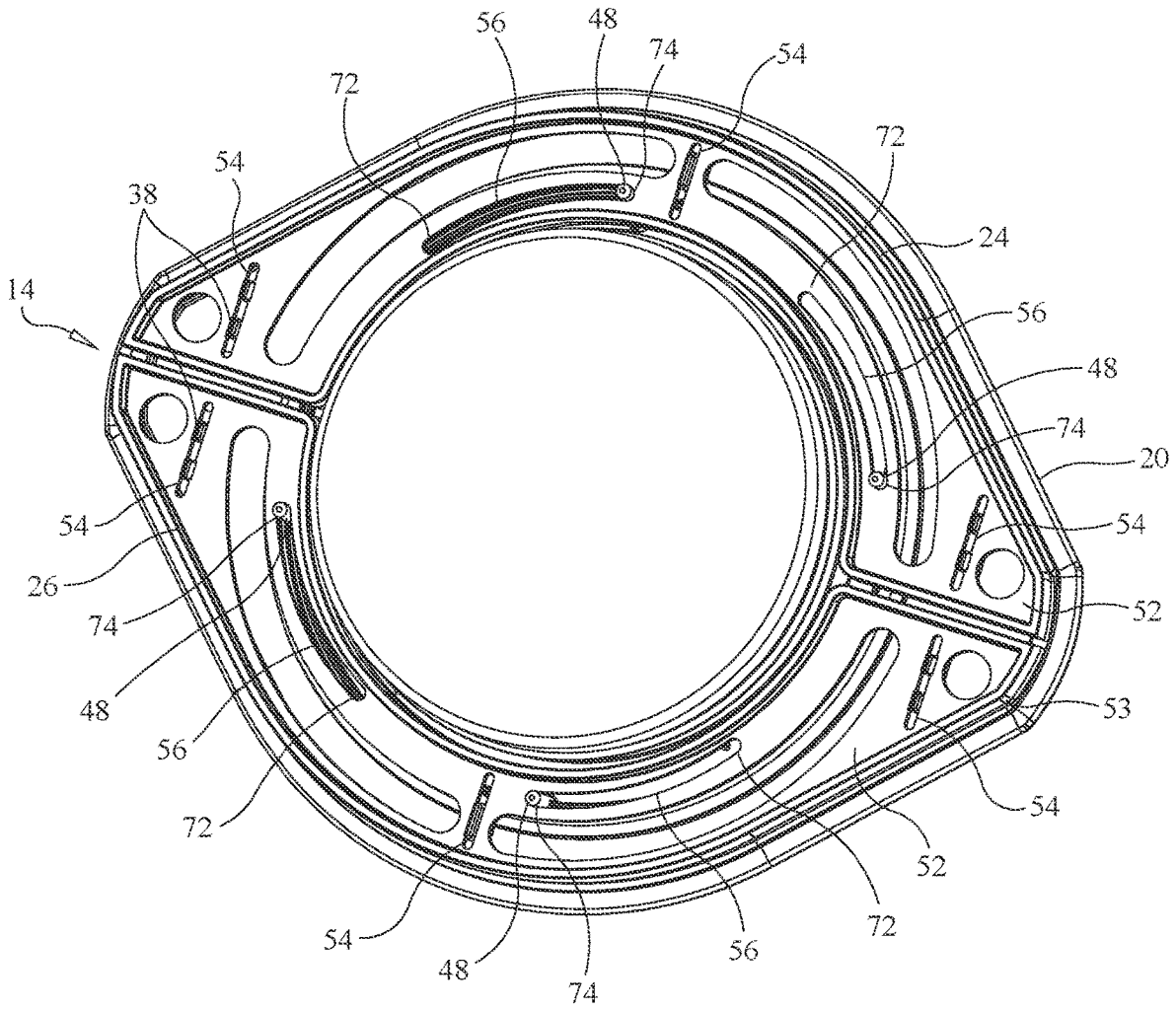
FIG. 14 illustrates a bottom perspective view of the lid assembly without the sealing part and with the illustrated elements in the unsealed configuration.
Figure 15:
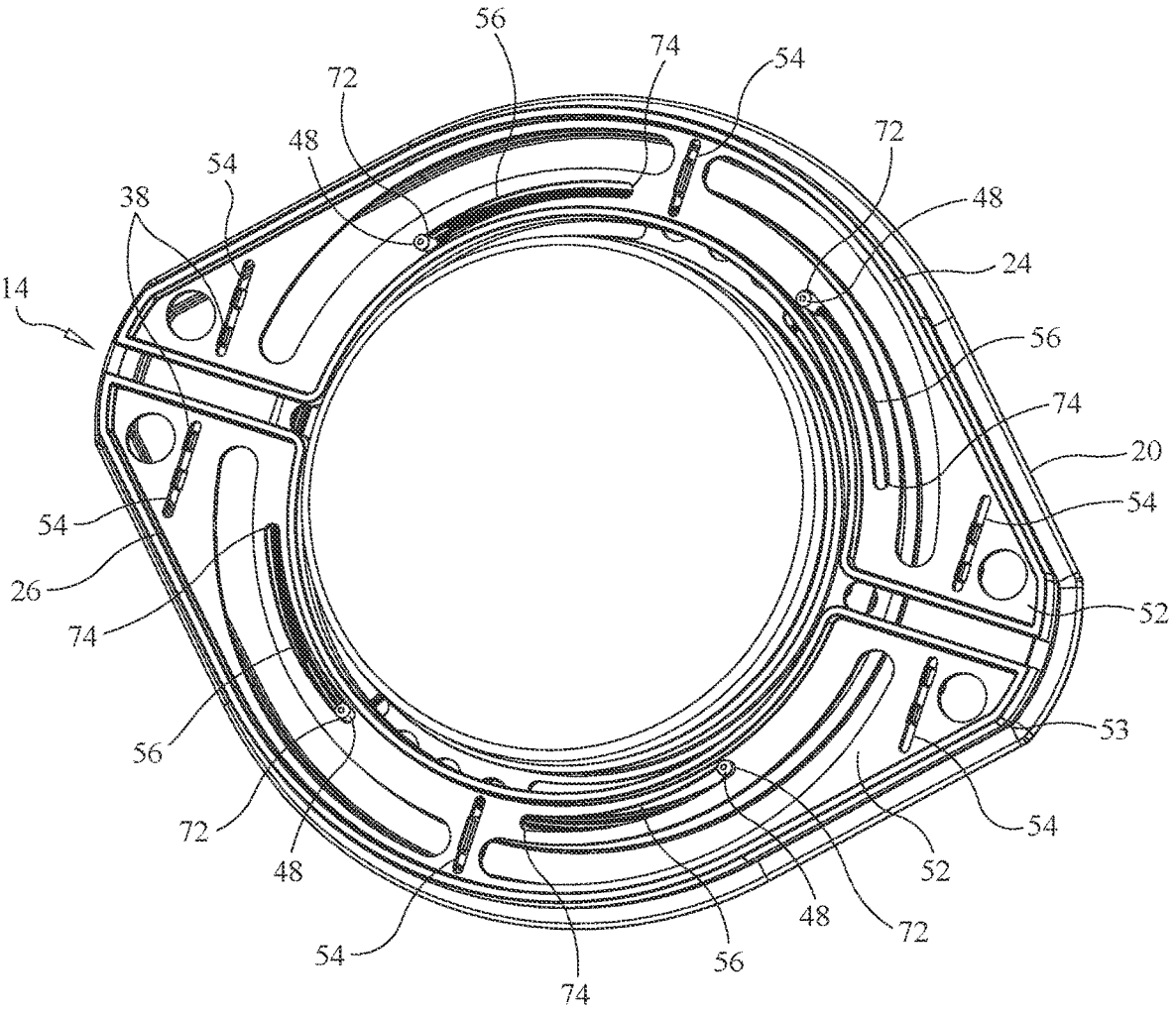
FIG. 15 illustrates a bottom perspective view of the lid assembly without the sealing part and with the illustrated elements in the sealed configuration.
Figure 16:
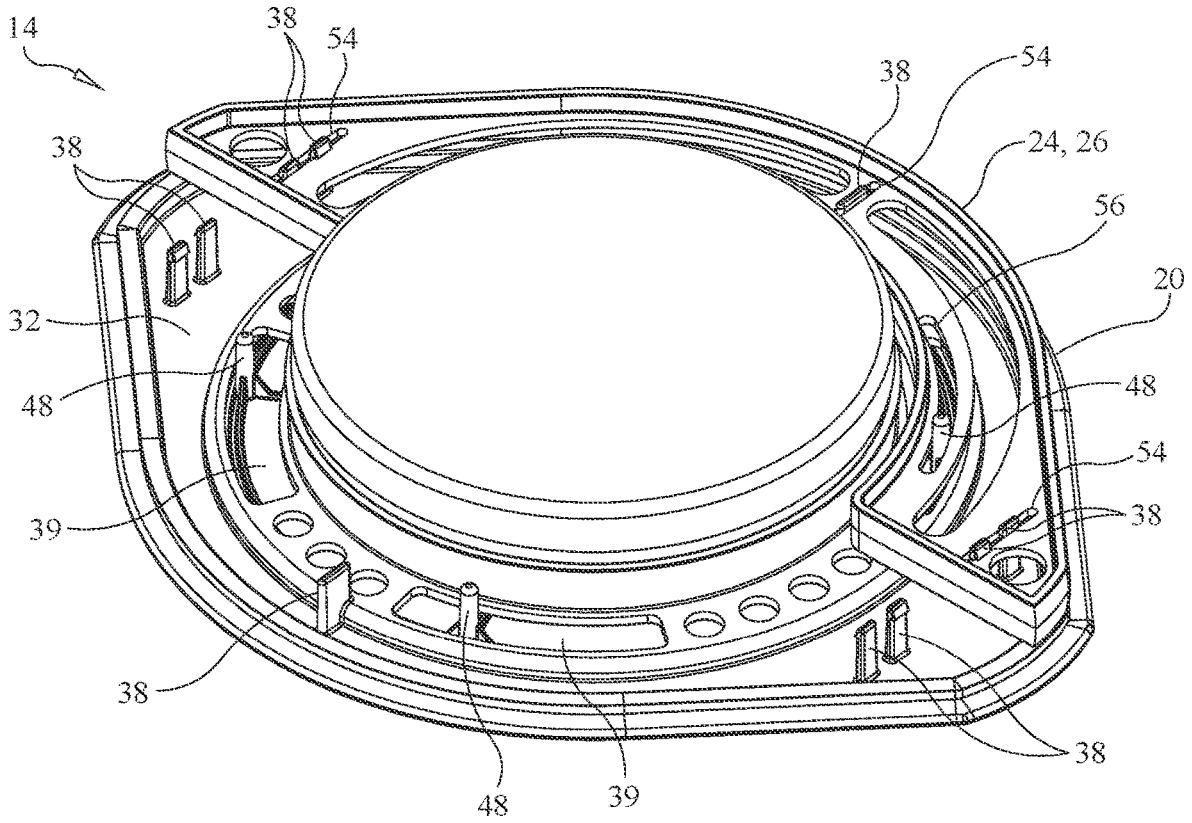
FIG. 16 illustrates a bottom perspective view of the lid assembly without the sealing part and a first or second sliding part.

In the illustrated embodiment, and as shown in FIGS. 14-16, the base part 20 includes at least one second protrusion 38. The second protrusions 38 extend downward from the bottom surface 32. In the illustrated embodiment, the second protrusions 38 extend downward from a portion of the bottom surface 32 that is radially outward from the cavity 34. As explained in more detail below, each second protrusion 38 interacts with the first slide part 24 or the second slide part 26 to restrict the first slide part 24 or the second slide part 26 to linear translation with respect to the base part 20. More specifically, each second protrusion 38 interacts with the first slide part 24 or the second slide part 26 to restrict the first slide part 24 or the second slide part 26 to linear translation in the radially outward and radial inward directions with respect to the center axis of the base part 20.

In the illustrated embodiment, and as shown in FIG. 16, the base part 20 includes at least one aperture 39. In the illustrated embodiment, the base part 20 includes four apertures 39 which are curved around the perimeter of the cavity 34. Here, the apertures 39 are positioned through the top surface 30 and bottom surface 32 at a position radially outward from the cavity 34. As explained in more detail below, each aperture 39 receives a second protrusion 48 of the rotating part 22 to allow the second protrusion 48 to interact with a slide part 24, 26 during rotation of the rotating part 22. As seen in FIG. 16, the second protrusions 48 are longer than the depths of their respective apertures 39 so as to extend beyond their respective apertures 39 and contact the first slide part 24 or second slide part 26.

As seen for example in FIGS. 7-10, the rotating part 22 includes a top surface 40, a bottom surface 42, and a side surface 43. The rotating part 22 includes one or more rotation assisting device which can be used by a user to rotate the rotating part 22 with respect to the base part 20. Here, the rotation assisting device includes one or more finger indentations 44 in the top surface 40. In the illustrated embodiment, the rotating part 22 includes four finger indentations 44. More or less finger indentations 44 can be used. In the illustrated embodiment, a user places his or her fingers in the finger indentations 44 to rotate the rotating part 22 with respect to the base part 20. As seen in FIG. 10, the finger indentations 44 extend into the cavity 34 when the rotating part 22 is attached to the base part 20. Alternatively, for example, the rotation assisting device can include one or more protrusion which extends upward from the top surface 40 which a user grabs to cause rotation of the rotating part 22. The rotating part 22 can be formed from plastic, for example, from ABS material. As should be understood by those of ordinary skill in the art from this disclosure, the rotating part 22 can also be formed in another suitable shape or from another suitable material. In an embodiment, the diameter of the rotating part is about 5 inches.

In the illustrated embodiment, and as seen in FIG. 10, the rotating part 22 includes a first protrusion 46 extending downward from the bottom surface 42. In the illustrated embodiment, the first protrusion 46 attaches to the first protrusion 36 of the base part 20 to rotatably attach the rotating part 22 to the base part 20. Here, the first protrusion 46 is located between the finger indentations 44. As seen in FIG. 10, the first protrusion 46 can extend into a center aperture in the first protrusion 36. The first protrusion 46 can attach to the first protrusion 36, for example, via a snap fit, press fit or another attachment mechanism. Those of ordinary skill in the art will recognize from this disclosure that there are various ways to rotationally attach the rotating part 22 to the base part 20.

In the illustrated embodiment, and as seen in FIGS. 14-16, the rotating part 22 includes at least one second protrusion 48. As explained in more detail below, each second protrusion 48 interacts with the first slide part 24 or the second slide part 26 so that rotation of the rotating part 22 causes the first slide part 24 or the second slide part 26 to translate with respect to the base part 20. More specifically, each second protrusion 48 interacts with the first slide part 24 or the second slide part 26 to cause the first slide part 24 or the second slide part 26 to translate radially outward and radially inward with respect to the base part 20.

As seen in FIGS. 14 and 15, the slide parts 24, 26 can be similarly or even identically formed. Each slide part 24, 26 includes a top surface 50, a bottom surface 52, and a side surface 53. Each slide part 24, 26 includes at least one first aperture 54 which interacts with the at least one second protrusion 38 of the base part 20. In the illustrated embodiment, each slide part 24, 26 includes three first apertures 54. As illustrated, the first apertures 54 are straight apertures which are elongated in the radial direction that the slide part 24, 26 translates. Each slide part 24, 26 also includes at least one second aperture 56 which interacts with at least one second protrusion 48 of the rotating part 22. In the illustrated embodiment, each slide part 24, 26 includes two second apertures 56. As illustrated, the second apertures 56 are curved with respect to the rotational center axis. In the illustrated embodiment, the second apertures 56 are located radially outward from the cavity 34 when the lid assembly 14 is assembled. In the illustrated embodiment, the first apertures 54 and the second apertures 56 extend all the way through the respective slide part 24, 26 between the top surface 50 and the bottom surface 52. Alternatively, the first apertures 54 and/or the second apertures 56 can be formed as indentations in the top surface 50 but not extend through the slide part 24, 26 to the bottom surface 52. The slide parts 24, 26 can be formed from plastic, for example, from ABS material. As should be understood by those of ordinary skill in the art from this disclosure, the slide parts 24, 26 can also be formed in other suitable shapes or from another suitable material.

Figure 12:
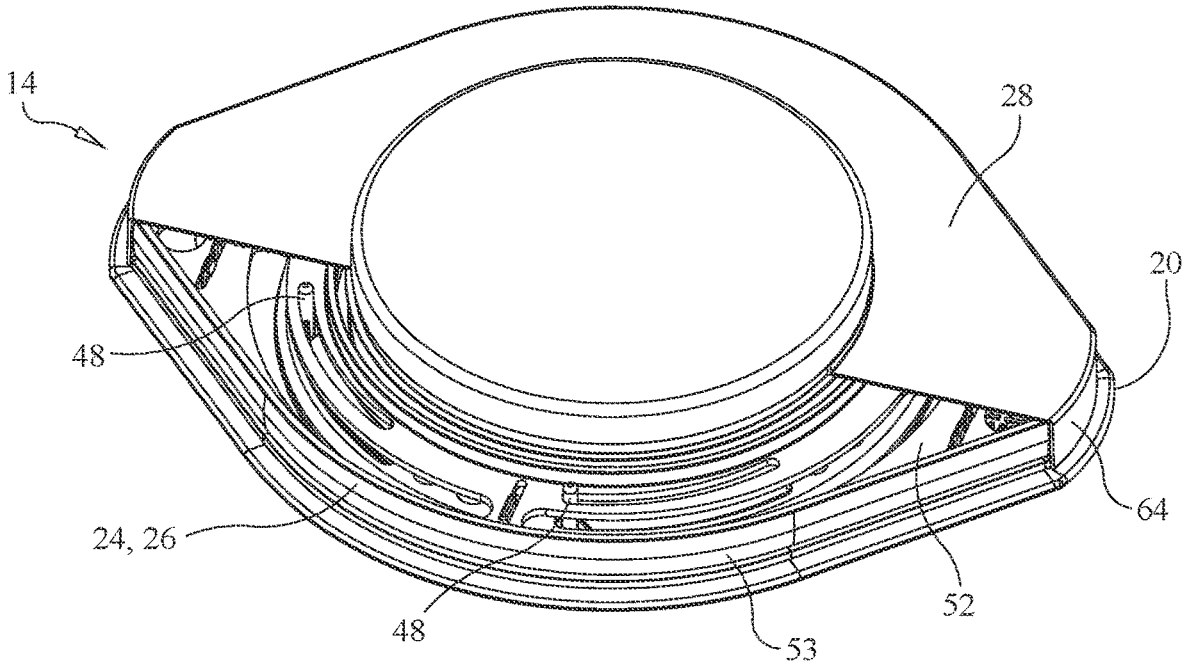
FIG. 12 illustrates a bottom perspective view of the lid assembly from the same perspective as FIG. 11 but with a portion of the sealing part removed to view other components.
Figure 13:
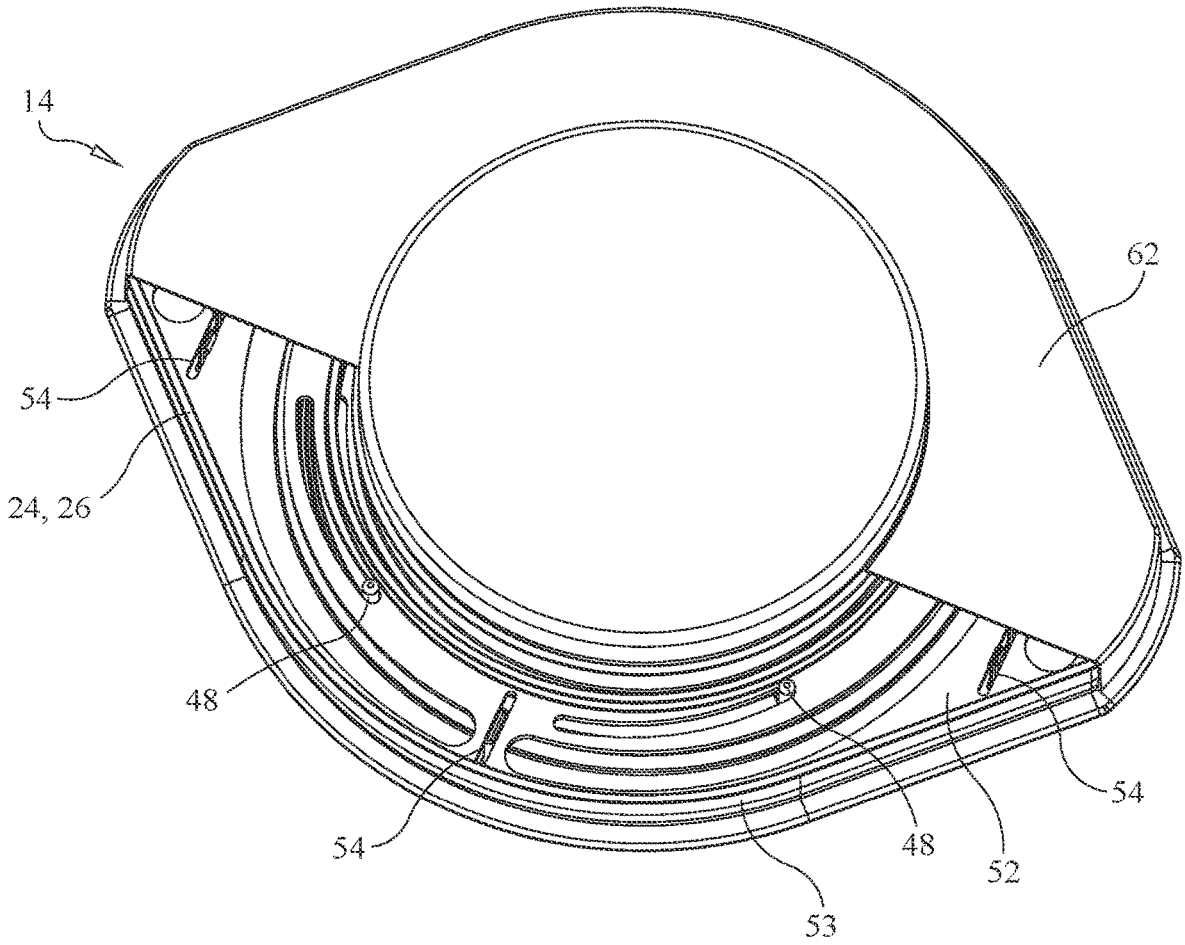
FIG. 13 illustrates another bottom perspective view of the lid assembly with a portion of the sealing part removed to view other components.
Figure 17:
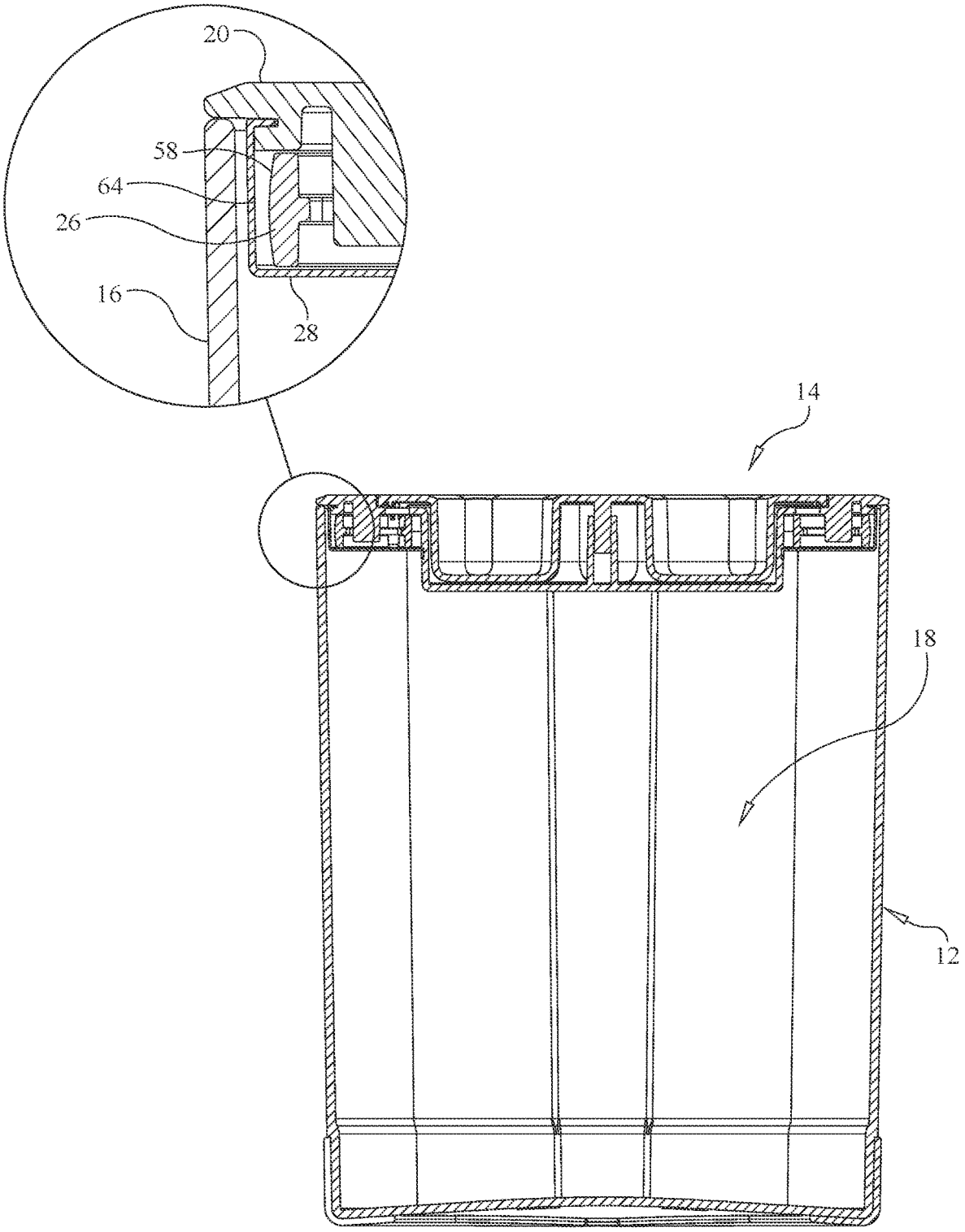
FIG. 17 illustrates a cross-section perspective view of the food container of FIG. 1 taken across section A-A in FIG. 3.

In the illustrated embodiment, and as seen in FIGS. 12 and 13, each slide part 24, 26 includes an outer side surface 58. In the illustrated embodiment, the outer side surface 58 has a contour that corresponds to that of the outer edge of the sealing part 28. In the illustrated embodiment, the outer side surface 58 also has a contour that corresponds to the contour of the side wall(s) 16 of the body 12. As seen in FIG. 17, the outer side surface 58 can be curved in the axial direction of the center axis (vertical in FIG. 17) such that a portion of the outer side surface 58 (here, the center in the vertical direction) applies increased pressure against the sealing surface 28 when the lid assembly 14 seals the interior space 18. As also illustrated in FIG. 17, the side surface 58 can be longer in the axial direction of the center axis (vertical in FIG. 17) than other portions of the slide part 24 (here, shown by the T-shape). In the illustrated embodiment, the side surface 58 is longer in the axial direction than the portions of the slide part 24, 26 including the first apertures 54 and/or the second apertures 56.

The sealing part 28 includes a top surface 60, a bottom surface 62, and a side surface 64. As seen for example in FIG. 7, the top surface 60 forms a cavity 66 with an aperture 68 in the center thereof. The aperture 68 receives the base part 20 with the slide parts 24, 26 located around the perimeter thereof. As seen for example in FIG. 17, the sealing surface can be attached to the base part 20 at or near the outer perimeter of the base part 20, In the illustrated embodiment shown in FIG. 17, the edge of the sealing part is received into an indentation in the base part. As also see in FIG. 17, when the sealing part is attached, the sealing part encloses the first slide part 24 and/or the second slide part 26 with the side surface 64 located between the outer side surface 58 of the slide part 24, 26 and the side wall(s) 16 of the body 12. When the slide part 24, 26 translates to seal the interior space (translates leftward in the detailed view of FIG. 17), the outer side surface 58 of the slide part 24, 26 presses the side surface 64 of the sealing part 28 into the side wall(s) 16 of the body 12.

The sealing part 28 is formed from a flexible material, for example silicon. As should be understood by those of ordinary skill in the art from this disclosure, the sealing part 28 can also be formed from another suitable material.

Figure 7:
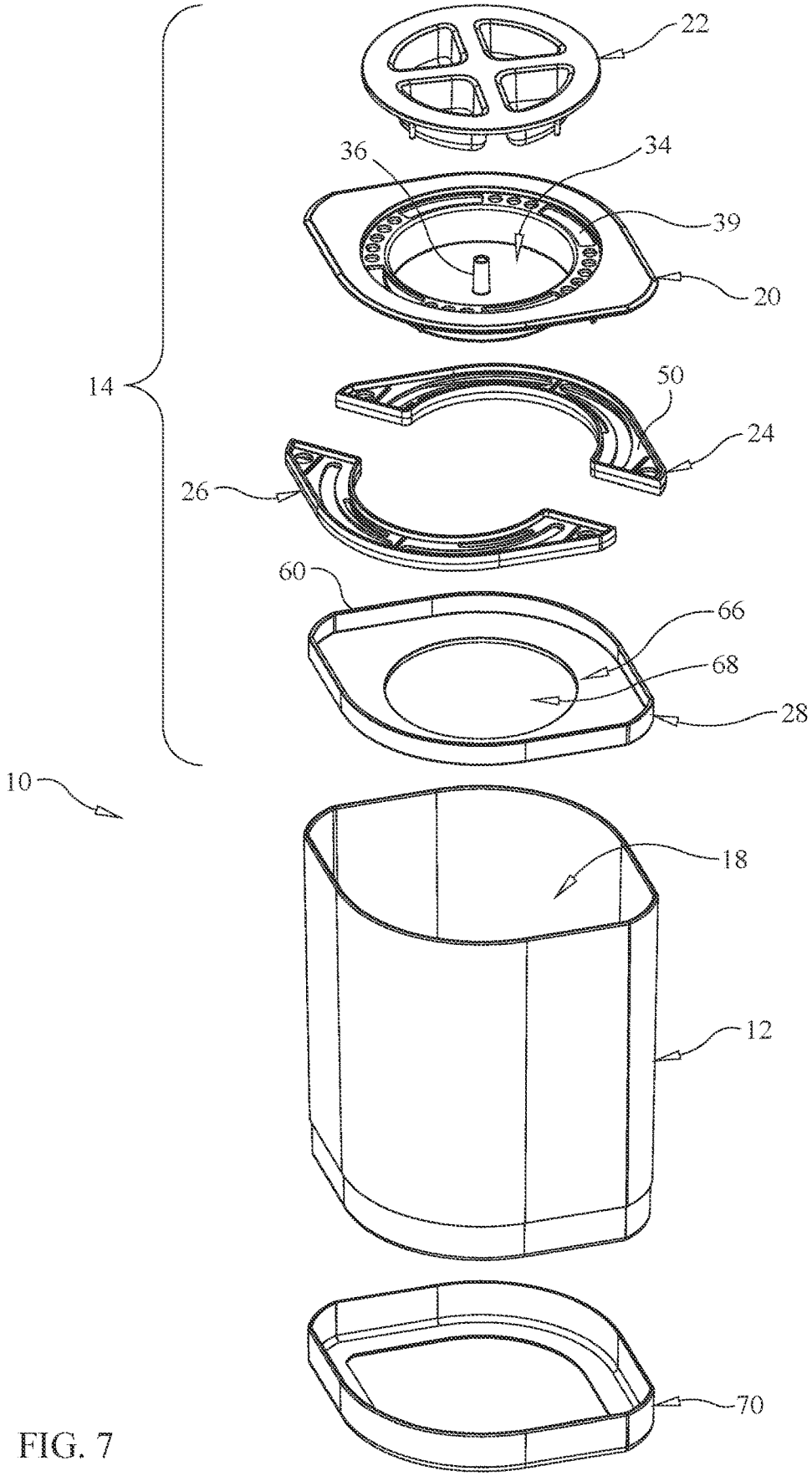
FIG. 7 illustrates an exploded view of the food container of FIG. 1.
Figure 8:
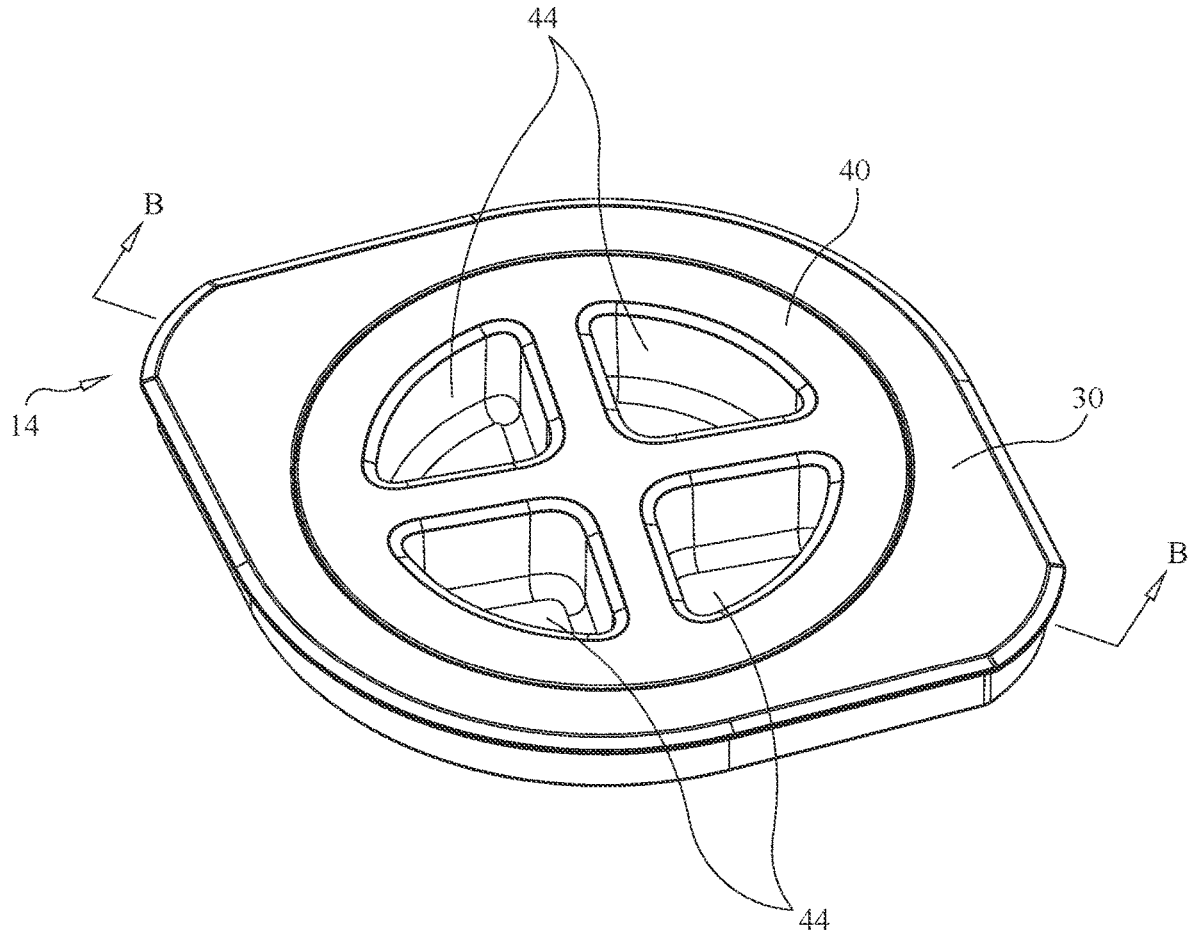
FIG. 8 illustrates a top perspective view of the lid assembly of the food container of FIG. 1, with the lid assembly in the unsealed configuration.
Figure 9:
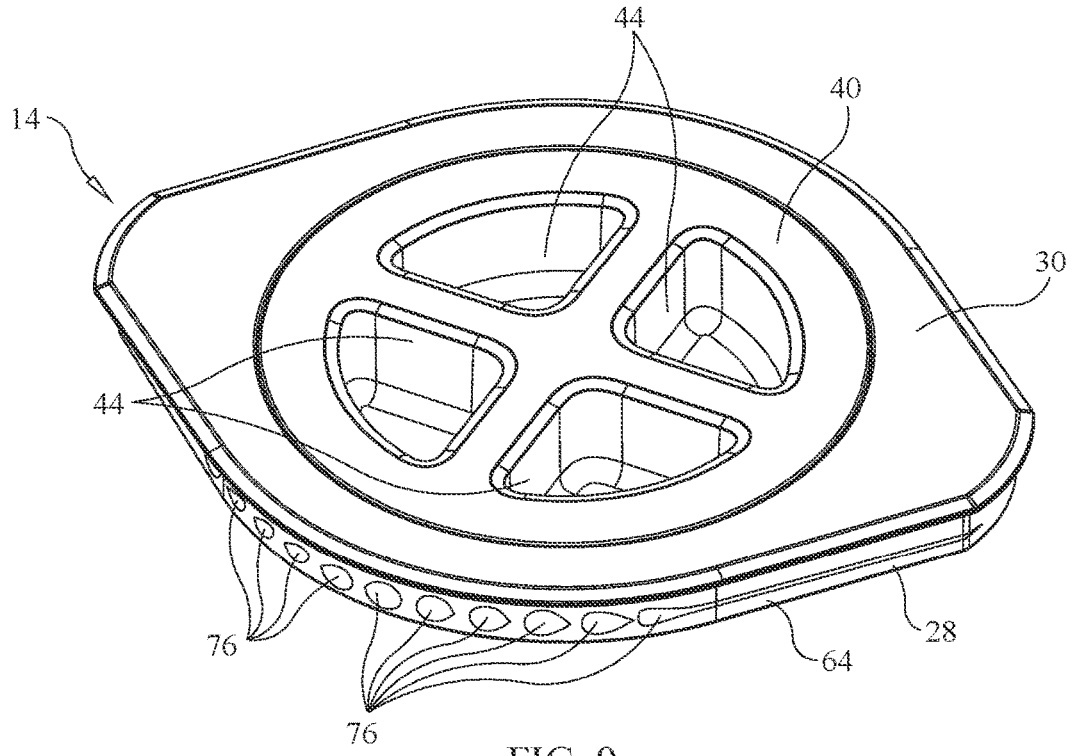
FIG. 9 illustrates a top perspective view of the lid assembly of the food container of FIG. 1, with the lid assembly in the sealed configuration.
Figure 18:
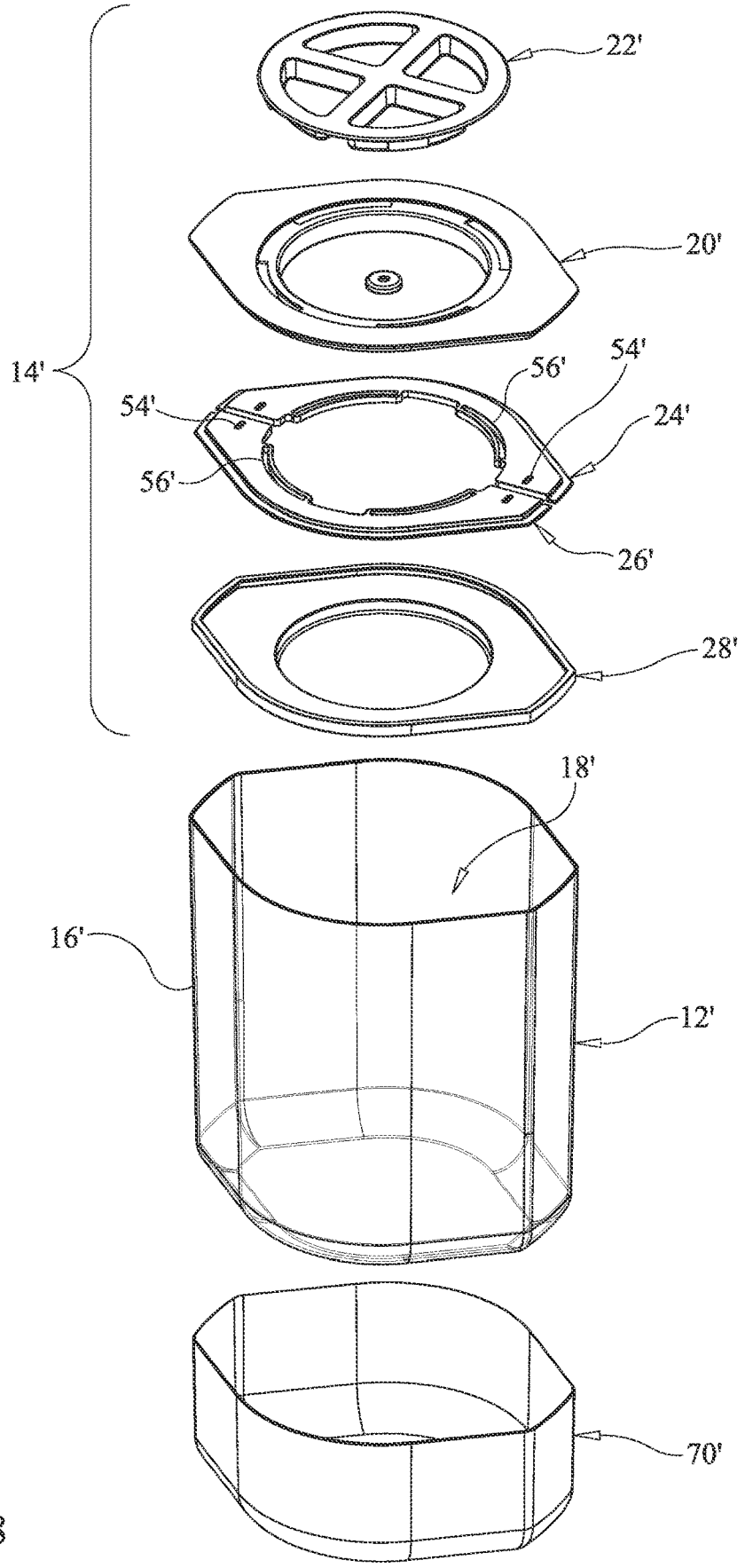
FIG. 18 illustrates an exploded view of an alternative example embodiment of a food container in accordance with the present disclosure.

In the illustrated embodiment, the food container 10 further includes a base 70. The base 70 fits around the body 12 at the bottom wall 15. More specifically, the base 70 fits around the edges of the body 12 where the side walls 16 meet the bottom wall 15. As seen in FIG. 7, in the illustrated embodiment, the base 70 is open in the center to leave a portion of the bottom wall 15 exposed. In an alternative embodiment, for example as seen in FIG. 18, the base 70 can cover the entire bottom wall 16 of the body 12. The base 70 can be formed from a material such as rubber, for example, EPDM 60 durometer rubber. As should be understood by those of ordinary skill in the art from this disclosure, the base 70 can also be formed from any other suitable material.

As seen in FIGS. 14 to 16, the second protrusions 38 of the base part 20 extend into the first apertures 54 of a slide part 24, 26. Here, the second protrusions 38 each include an edge with an outwardly extending lip which causes a snap fit to attach the slide part 24, 26 to the base part 20. When configured as shown, the interaction between the second protrusions 38 and the first apertures 54 permits back and forth translation of the slide part 24, 26 with respect to the base part 20 in a linear direction. More specifically, the interaction between the second protrusions 38 and the first apertures 54 permits radially inward and radially outward translation with respect to the rotational center axis. In the illustrated embodiment, the interaction between the second protrusions 38 and the first apertures 54 restricts translation of the slide part 24, 26 to only the linear direction with respect to the base part 20.

As also seen in FIGS. 14 to 16, the second protrusions 48 of the rotating part 22 extend through the apertures 39 of the base part 20 and into the second apertures 56 of a slide part 24, 26. As seen in FIGS. 14 and 15, each second aperture 56 extends from a first end 72 to a second end 74. In the illustrated embodiment, the first end 72 is closer to the center axis of the lid assembly 14 than the second end 74. This way, rotation of the rotating part 22 in a first direction (e.g., counterclockwise toward the first end 72 in the perspective of FIGS. 14 and 15) pushes the slide parts 24, 26 radially outwardly with respect to the center axis, while rotation of the rotating part 22 in an opposite second direction (e.g., clockwise toward the second end 74 in the perspective of FIGS. 14 and 15) pushes the slide parts 24, 26 radially inwardly with respect to the center axis.

FIG. 14 illustrates the lid assembly in the unsealed configuration, while FIG. 15 illustrates the lid assembly in the sealed configuration. As seen in FIG. 14, when the second protrusions 48 are located at the second ends 74, the slide parts 24, 26 are at their innermost configuration. This is the unsealed configuration. As seen in FIG. 15, when the second protrusions 48 are located at the first ends 72, the slide parts 24, 26 are at their outermost configuration. This is the sealed configuration. In the sealed configuration, the slide parts 24, 26 apply pressure against the sealing part 28 at one or more pressure points 76, as seen for example in FIG. 9. More specifically, the side surface 58 of the slide parts 24, 26 apply pressure against the sealing part 28. This pressure presses the side surface 64 of the sealing part 28 into the side wall(s) 16 of the body 12 to seal the interior space 18. The first ends 72 and/or second ends 74 can include indentations or protrusions which receive the second protrusions 48 to maintain the sealed or unsealed configuration until rotational pressure is applied by a user.

Thus, in use, when the rotating part 22 is rotated with respect to the base part 20, the second protrusions 48 push the slide parts 24, 26 outwardly or inwardly with respect to the other the parts of the lid assembly 14. This causes the sealing part 28 to press against the side surface(s) 16 of the body 12. The interaction between the second protrusions 38 of the base part 20 and the first apertures 54 of the slide parts 24, 26 ensure that the slide parts 24, 26 translate linearly while being pushed by the second protrusions 48.

In the illustrated embodiment, the amount of rotation by the rotating part 22 needed to seal and unseal the interior space 18 corresponds to the length of the second apertures 56. Thus, the illustrated embodiment requires less than a quarter turn of the rotating part 22 to seal and unseal the interior space 18. Those of ordinary skill in the art will recognize from this disclosure that various embodiments may use more or less rotation to seal and unseal the interior space 18.

Various materials can be used to form the parts discussed herein. These materials include, for example, acrylonitrile butadiene styrene (ABS) styrene-acrylonitrile (SAN) resin, thermoplastic rubber (TPR), polyethylene terephthalate (PET), high impact styrene (HIS), styrene acrylonitrile (SAN), copolyester (PPC), acrylic such as polymethyl methacrylate (PMMA), polycarbonate blends such as styrene maleic anhydride (SMA), clarified polypropylene, polystyrene, and/or silicon. The materials should also be food safe if the container is intended for food.

Figure 19:
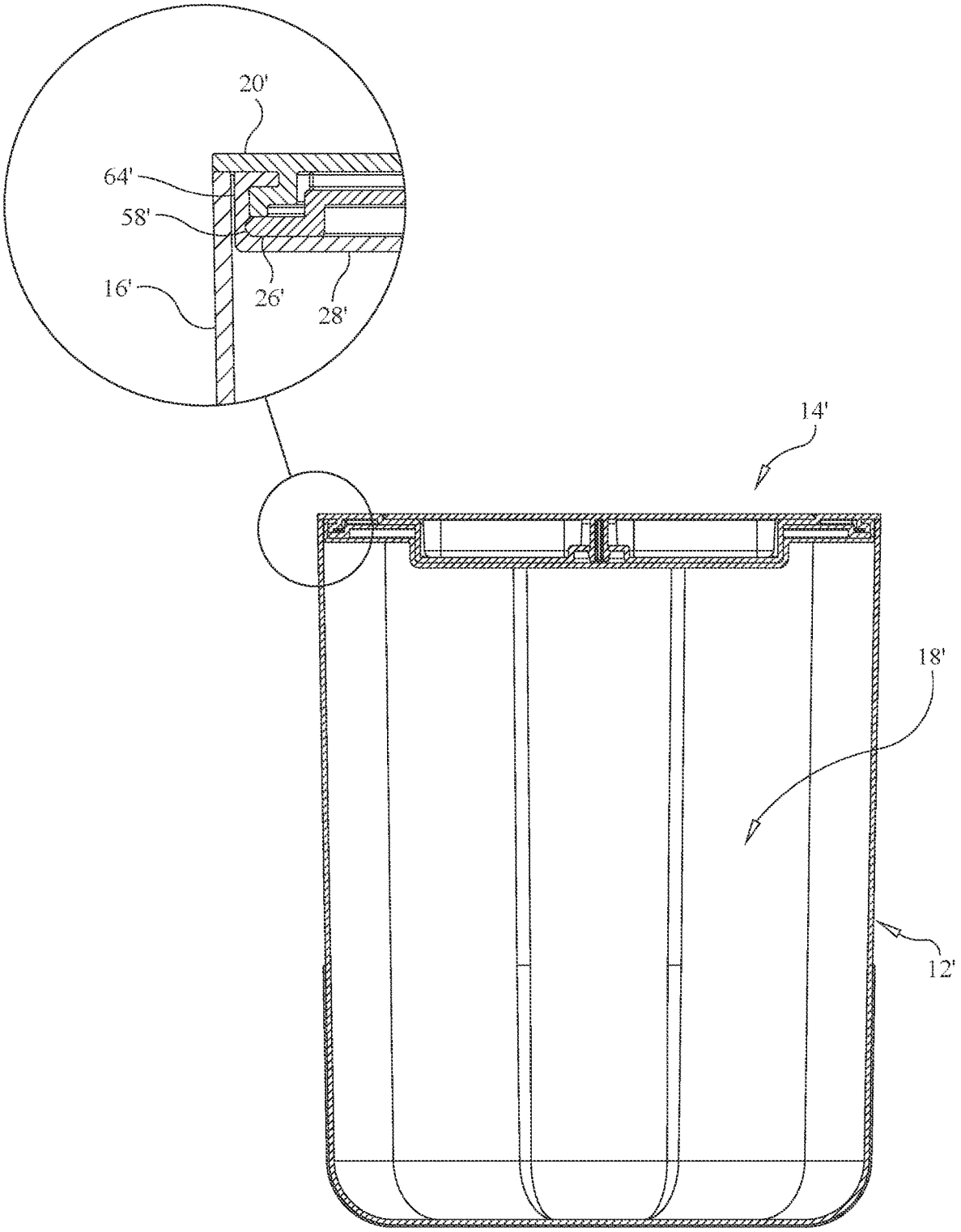
FIG. 19 illustrates a cross-sectional view taken through the center of the fully constructed food container of FIG. 18.

FIGS. 18 to 20 illustrate a second example embodiment of a food container 10' in accordance with the present disclosure. The food container 10' shown in FIGS. 18 to 20 operates generally the same as the food container 10 shown in FIGS. 1 to 17 with minor changes to various parts as shown. It should be understood to those of ordinary skill in the art from this disclosure that parts of the food container 10' can be added to the food container 10, and vice versa.

As illustrated in FIG. 18, the food container 10' includes a body 12' and a lid assembly 14'. The lid assembly 14' is removeable from the body 12'. The lid assembly 14' is configured to provide an airtight seal which can be easily sealed and unsealed by a rotational force provided by a user. The food container 10' also includes a base 70' that covers the entire bottom wall of the body 12' in this embodiment.

Like with the first embodiment, the lid assembly 14' includes a base part 20', a rotating part 22', a first slide part 24', a second slide part 26', and a sealing part 28'. The base part 20' and rotating part 22' have a center axis about which the rotating part 22' rotates with respect to the base part 20'. In use, the rotating part 22' rotates around its center axis with respect to the base part 20' to seal or unseal the interior space 18' of the body 12'. As with the first embodiment, the rotation of the rotating part 22' causes the first slide part 24' and the second slide part 26' to translate radially in opposite directions with respect to the center axis. The first slide part 24' and the second slide part 26' translate with respect to the base part 20', the rotating part 22', and the sealing part 28'. During translation in the outward radial direction (away from the central axis), the first slide part 24' and the second slide part 26' press the sealing part 28' into the side wall 16' of the body 12', thus sealing the interior space 18' of the body 12' with an airtight seal. During translation in the inward radial direction (toward the central axis), the first slide part 24' and the second slide part 26' release the pressure pressing the sealing part 28' into the side wall 16 of the body 12', thus unsealing the airtight seal provided to interior space 18' by the lid assembly 14'.

Also like with the first embodiment, the base part 20' includes at least one protrusion (not shown) that interacts with a first apertures 54' of the first slide part 24' or the second slide part 26' to restrict the first slide part 24' or the second slide part 26' to linear radial translation with respect to the center axis. Also, the rotating part 22' includes at least one protrusion (not shown) that interacts with a second aperture 56' of the first slide part 24' or the second slide part 26' so that rotation of the rotating part 22' causes the first slide part 24' or the second slide part 26' to translate radially with respect to the base part 20'. When the slide part 24', 26' translates to seal the interior space (translates leftward in the detailed view of FIG. 19), the outer side surface 58' of the slide part 24', 26' presses the side surface 64' of the sealing part 28' into the side walls) 16' of the body 12'.

FIGS. 18-20 illustrate how the shapes of certain parts can differ in different embodiments. As illustrated, the base part 20', slide part 24', 26' and sealing part 28' are shaped differently than the corresponding parts of the first embodiment of the food container 10. For example, as seen in FIG. 19, the outer side surface 58' of the slide part 24', 26' is narrower than the outer side surface 58 illustrated in FIG. 17. As another example difference seen in FIG. 18, the sealing part 28' has an aperture that does not go all the way through the sealing part 28', compared to the aperture 68 through the top and bottom surfaces of the sealing part 28 as illustrated in FIG. 17. FIGS. 18-20 thus show that variations of the structure shown in FIGS. 1-17 are possible without departing from the spirit and scope of the present disclosure.

Figure 20A:
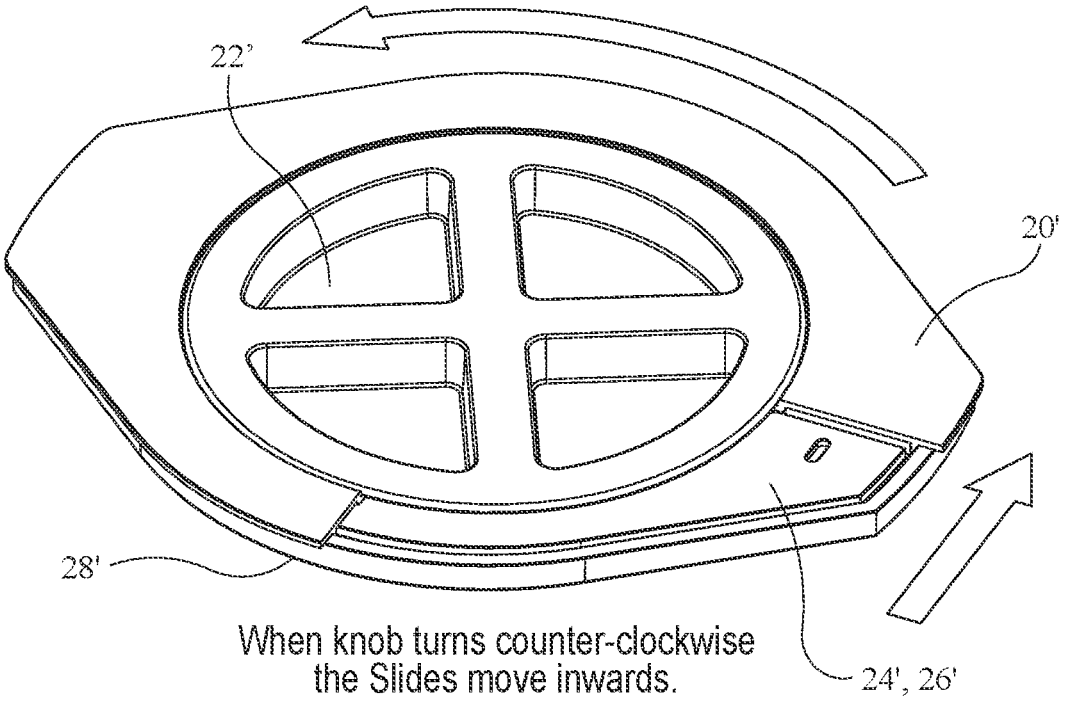
FIGS. 20A and 20B illustrates opening and closing of the lid assembly of the food container of FIG. 18.
Figure 20B:
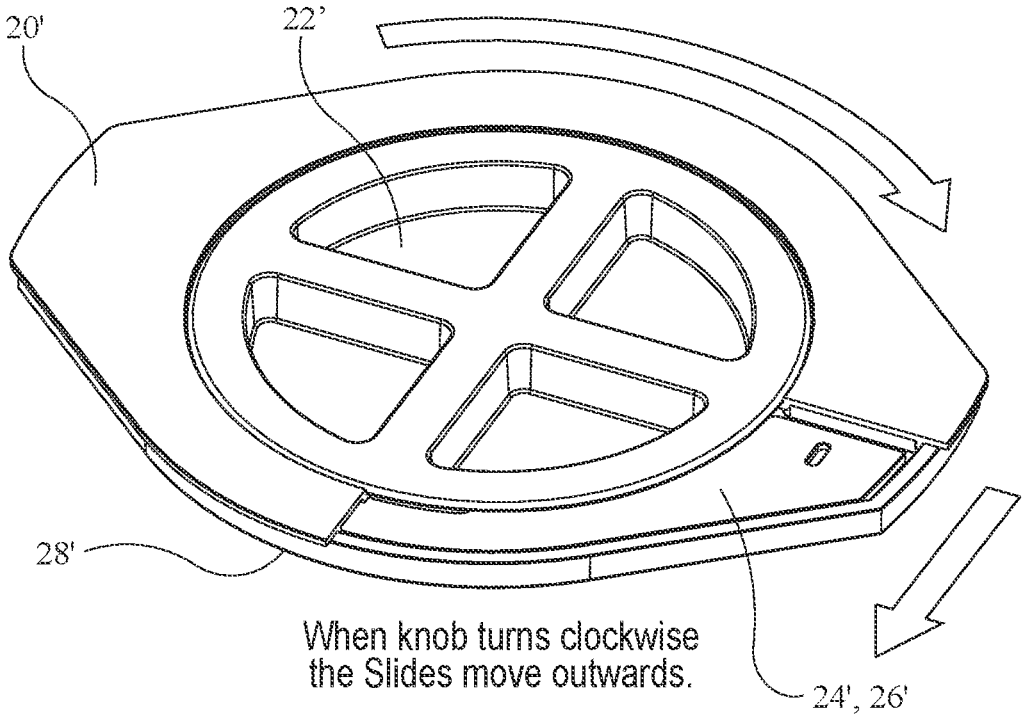

FIG. 20A illustrates unsealing of the lid assembly 14' when the rotating part 22' is rotated counter-clockwise with respect to the base part 20'. This motion forces the slide parts 24', 26' radially inward toward the center axis and away from the sealing part 28' to release the sealing part 28' from the side wall(s) 16' of the body 12' and thus unseal the interior space 18'. FIG. 20B illustrates sealing of the lid assembly 14' when the rotating part 22' is rotated clockwise with respect to the base part 20'. This motion forces the slide parts 24', 26' radially outward away from the center axis and toward the sealing part 28' to press the sealing part 28' into the side wall(s) 16' of the body 12' and thus seal the interior space 18'.

The embodiments described herein provide improved food containers that are durable, provide a reliable seal, and easy to seal and unseal. It should be understood that various changes and modifications to the food containers and corresponding components described herein will be apparent to those skilled in the art and can be made without diminishing the intended advantages.

General Interpretation of Terms in understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "section" or "portion" when used in the singular can have the dual meaning of a single part or a plurality of parts.

The term "configured" as used herein to describe a component, section or part of a device that is constructed to carry out the desired function.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed:

1. A food container comprising:

a body having an interior space; and a lid assembly including:

a rotating part having a center axis and including at least one protrusion offset from the center axis, a base part, the at least one protrusion extending through the base part, and at least one slide part including at least one aperture offset from the center axis, the at least one aperture extending from a first end to a second end, the first end located closer to the center axis than the second end, the at least one protrusion of the rotating part projecting into the at least one aperture of the at least one slide part and configured to move back and forth from the first end to the second end of the at least one aperture of the at least one slide part to cause the at least one slide part to translate linearly when the rotating part is rotated to cause the interior space to be sealed or unsealed.

2. The food container of claim 1, wherein the rotating part rotates with respect to the base part, and the at least one slide part translates linearly with respect to the base part.

3. The food container of claim 1, wherein the lid assembly includes a sealing part, and the at least one slide part presses the sealing part into the body when the at least one slide part translates linearly.

4. The food container of claim 1, wherein the rotating part rotates around the center axis, and the at least one slide part translates radially inwardly and radially outwardly with respect to the center axis.

5. The food container of claim 1, wherein the base part includes a cavity that receives the rotating part.

6. The food container of claim 1, wherein the at least one protrusion is at least one first protrusion, and the base part has at least one second protrusion which restricts translation of the at least one slide part to only a linear direction.

7. The food container of claim 1, wherein the at least one slide part includes a first slide part and a second slide part which simultaneously translate in opposite directions.

8. The food container of claim 7, wherein the rotating part rotates around the center axis, the first slide part and the second slide part translate radially outwardly with respect to the center axis to seal the interior space, and the first slide part and the second slide part translate radially inwardly with respect to the center axis to unseal the interior space.

9. A food container comprising:

a body including one or more side wall surrounding an interior space; and a lid assembly having a first length and a second length that are different, the lid assembly including:

a rotating part configured to rotate around a center axis including a plurality of protrusions, a base part, the plurality of protrusions extending through the base part, a first slide part including a first aperture, a second slide part including a second aperture, and a sealing part located radially outward from the first slide part and the second slide part with respect to the center axis, at least one of the plurality of protrusions projecting into each of the first aperture and the second aperture and configured to cause the first slide part and the second slide part configured to translate along the first length or the second length in opposite directions to press the sealing part into the one or more side wall to seal the interior space.

10. The food container of claim 9, wherein rotation of the rotating part causes the first slide part and the second slide part to translate in opposite directions.

11. The food container of claim 9, wherein the first slide part and the second slide part translate away from each other in a linear direction to seal the interior space, and the first slide part and the second slide part translate toward each other to unseal the interior space.

12. The food container of claim 9, wherein the rotating part rotates with respect to the base part, and at least one of the first slide part and the second slide part translates linearly with respect to the base part.

13. The food container of claim 12, wherein the plurality of protrusions of the rotating part include first protrusions extending through the base part to each of the first slide part and the second slide part to cause the first slide part and the second slide part to translate in opposite directions during rotation of the rotating part, and the base part includes second protrusions extending to each of the first slide part and the second slide part which restrict translation of the first slide part and the second slide part to only a linear direction.

14. A lid assembly for a food container, the lid assembly comprising:

a base part including at least one aperture;

a rotating part configured to rotate around a center axis with respect to the base part; and at least one slide part configured to translate linearly with respect to the base part due to a rotation of the rotating part;

a sealing part configured to be pressed by the at least one slide part when the at least one slide part translates linearly with respect to the base part due to the rotation of the rotating part; and at least one protrusion extending from the rotating part through the at least one aperture of the base part, the at least one protrusion being offset from the center axis and projecting into the at least one slide part at a location offset from the center axis, wherein the base part is positioned between the rotating part and the at least one slide part in an axial direction of the center axis with the at least one aperture being offset from the center axis, the base part configured to restrict the at least one slide part to linear translation as the at least one protrusion causes the at least one slide part to translate in a radial direction to seal and unseal the food container when the rotating part is rotated around the center axis.

15. The lid assembly of claim 14, wherein the at least one protrusion is at least one first protrusion, and the base part includes at least one second protrusion that extends to the at least one slide part to restrict the at least one slide part to the linear translation during rotation of the rotating part.

16. The lid assembly of claim 14, wherein:

the at least one slide part includes a first slide part and a second slide part, the at least one aperture includes a plurality of apertures, and the at least one protrusion includes a plurality of protrusions projecting through the plurality of apertures and causing each of the first slide part and the second slide part to translate with respect to the base part.

17. The lid assembly of claim 14, wherein the at least one slide part includes a first slide part and a second slide part which simultaneously translate in opposite directions.

18. The lid assembly of claim 17, wherein the first slide part and the second slide part translate radially outwardly with respect to the center axis, and the first slide part and the second slide part translate radially inwardly with respect to the center axis.

* * * * *